United States Patent [19]

Schön et al.

[11] Patent Number: 4,480,027

[45] Date of Patent: Oct. 30, 1984

[54] PHOTOGRAPHIC RECORDING MATERIAL FOR THE PRODUCTION OF COLOR IMAGES TO BE VIEWED BY REFLECTED LIGHT

[75] Inventors: Erwin Schön, Leverkusen; Karl-Wilhelm Schranz, Odenthal; Erich Wolff, Leverkusen, all of Fed. Rep. of Germany

[73] Assignee: Agfa-Gevaert Aktiengesellschaft, Leverkusen, Fed. Rep. of Germany

[21] Appl. No.: 438,937

[22] Filed: Nov. 3, 1982

[30] Foreign Application Priority Data

Nov. 14, 1981 [DE] Fed. Rep. of Germany ..... 3145289

[51] Int. Cl.[3] ..... G03C 1/76

[52] U.S. Cl. ..... 430/523; 430/405; 430/527; 430/531; 430/533; 430/543; 430/950

[58] Field of Search ..... 430/496, 531, 533, 510, 430/523, 543, 950, 527

[56] References Cited

U.S. PATENT DOCUMENTS

| | | | |
|---|---|---|---|
| 3,220,842 | 11/1965 | Carroll et al. | 430/256 |
| 3,340,062 | 9/1967 | Hunter et al. | 430/531 |
| 3,751,528 | 8/1973 | Howe et al. | 96/81 |
| 3,925,081 | 12/1975 | Chiklis | 430/533 |
| 4,025,682 | 5/1977 | Ciecivch et al. | 430/531 |
| 4,355,099 | 10/1982 | Trautweiler | 430/531 |

*Primary Examiner*—J. Travis Brown

*Attorney, Agent, or Firm*—Connolly and Hutz

[57] ABSTRACT

A photographic recording material for the production of color images to be viewed by reflected light contains, on a transparent support layer at least 60 μm in thickness with smooth surfaces, a plurality of silver halide emulsion layers with differing spectral sensitivities and color couplers associated therewith and a light reflective opaque layer of binder. The material is developed chromogenically from the coated side. Exposure and viewing are carried out through the transparent support layer.

2 Claims, No Drawings

PHOTOGRAPHIC RECORDING MATERIAL FOR THE PRODUCTION OF COLOR IMAGES TO BE VIEWED BY REFLECTED LIGHT

This invention relates to a photographic recording material for the production of colour images to be viewed by reflected light, comprising a layer combination consisting of a transparent support layer, at least one light sensitive silver halide emulsion layer with colour coupler associated therewith, and a light-reflective, opaque layer of binder, in that order.

In conventional photographic recording materials for the production of colour images to be viewed by reflected light ("colour paper"), opaque support layers are used, e.g. baryta paper or paper which has been rendered hydrophobic on one or both sides by a coating with polyolefines such as polyethylene. The opaque support layer generally provides the pale, preferably white, light-reflective image background for the image to be produced for viewing by reflected light. Such recording materials have, however, various disadvantages.

If paper which has not been rendered hydrophobic is used as a support layer, the most serious disadvantages lie in the absorbency of the paper and the fact that paper loses its mechanical strength and dimensional stability when processed in the wet state. The absorbency has the disadvantage that large quantities of processing chemicals are absorbed in the paper felt in the course of the process and must subsequently be removed by time-consuming washing treatments. When using paper supports which have been rendered hydrophobic, considerable problems of adherence and of casting arise, generally necessitating additional measures, for example corona irradiation to enable these supports to be coated. The back of paper supports which have been rendered hydrophobic is not suitable for the application of marks or writing. Ageing is frequently accompanied by progressive brittleness of the polyethylene coating and of the photographic layers, resulting in premature destruction of the image. In the case of hydrophobic paper supports which have been cut to size, a further problem lies in the penetration at the edges, which means that processing chemicals penetrate the unprotected cut surfaces to enter the paper felt and cause discolouration at the edges. Regardless of the type of support layer employed, further disadvantages of this arrangement of layers lie in the fact that the photographic layers require to be coated with a so called protective layer in order to protect them against mechanical damage and that additional measures are required in order to improve the stability to light, e.g. coating of the completely processed image with a UV-absorbent layer or the incorporation of a UV-absorbent in one of the layers present or even in an additional layer of the photographic material. These measures will, of course, result in an additional coating weight, whereby the mechanical properties will be impaired and there will be a risk of bleeding of the chemical constituents.

In a colour photographic recording material for the production of images viewed by reflected light described in EP-A 0,007,048, some of the disadvantages mentioned above can be avoided since the photographic layers are exposed and the resulting images viewed through a transparent support layer while the processing liquids required for development enter the photographic layers from the active, coated side, and the recording material is bonded to a main support after processing. To facilitate bonding of the material to the main support, the transparent layer support is a thin auxiliary support not more than 50 μm in thickness. In one particular embodiment, a reflection layer may be placed above the photographic layers so that the image produced may be independent of the reflection characteristics of the main support. One disadvantage of the known recording material is that the method employed for its processing necessarily includes bonding of the material to the main support, which is very cumbersome.

It is an object of the present invention to provide a photographic recording material for the production of colour images to be viewed by reflected light, which material should be simple to produce (i.e. no problems of bonding or casting) and easy to process and will give rise to images which will be protected against mechanical damage without the aid of a separate protective layer and will have a suitable surface at the back for inscriptions.

The present invention provides a photographic recording material for the production of colour images to be viewed by reflected light, comprising a layer combination consisting of the following components in the sequence given: a transparent support layer, a light-sensitive element of one or more light-sensitive silver halide emulsion layers each having non-diffusible colour couplers spectrally associated therewith, and a light-reflective opaque layer of binder, characterised in that the transparent support layer has a thickness of at least 60 μm and a surface gloss on each of its surfaces of 60 to 100%, measured at 45° in a Goniometer and using a black glass plate as standard.

The essential layer elements of the recording material according to the invention are thus:

1. a transparent support layer;
2. a light sensitive element, and
3. a light reflective, opaque layer;

the three elements being arranged in the sequence indicated above to form an inseparable layer combination. This means that the layers are arranged one above the other in such a manner that at no time during their preparation, storage and processing or during subsequent storage of the completed image under the usual conditions can the layers be separated, not even temporarily. In particular, no separation should be possible between the transparent support layer and the light-sensitive element. The layer elements indicated above are cast one above the other in the given sequence in the usual manner and adhere firmly to each other. It should be particularly mentioned that unrestricted access of developer and processing chemicals into the photographic layers should be possible from the side remote from the transparent support layer, which means that no layer support impermeable to aqueous processing liquids may be present on this side during processing.

The transparent support layer (layer element 1) for the colour photographic recording material according to the invention may consist of any of the usual transparent support materials used in photographic practice, e.g. films of cellulose esters, polyethylene terephthalate, polycarbonates or other film forming polymers.

Since the transparent support layers used in the colour photographic recording material according to the invention also function as the main support layers, they must have sufficient rigidity and dimensional stability. This condition is generally fulfilled by using the usual transparent layer supports with thicknesses of 60 μm and upwards. It is preferred to use transparent support layers with thicknesses in the region of 60 to 300 μm, the particular thickness used in any individual case depending mainly on the nature of the support material and its optical properties. Thicknesses above 90 μm, for example, provide satisfactory results when using cellulose triacetate foil while thicknesses above 70 μm are most suitable when using polyethylene terephthalate foil.

Another important characteristic of the support layer apart from its supporting characteristics is that it should have sufficient transparency. Since the colour images produced with the recording material according to the invention are required to be viewed through the support layer, the support must be optically clear and permit unhindered viewing of the colour image from various directions. In particular, every image point should be visible to both eyes of an observer from every viewing angle below the critical angle of total reflection. This condition will be fulfilled if the layer support has two smooth, glossy surfaces. As already mentioned above, these surfaces should have a surface gloss of 60 to 100% (macroscopically) measured at 45° in a Goniometer, using a black glass plate as standard.

To improve the stability to light of the recording material according to the invention, the layer support or a transparent auxiliary layer applied to it may be equipped with a UV absorbent in known manner.

The light sensitive element (layer element 2) of the colour photographic recording material according to the invention contains at least one silver halide emulsion layer and at least one colour coupler associated with this silver halide emulsion layer. The term "associated" means that the spatial arrangement of silver halide emulsion layer and colour coupler is such that they are capable of interacting in the course of chromogenic development in such a manner as to provide for image-wise correspondence between the silver image formed in the course of colour development and the image-wise distribution of the chromogenically produced dye. The colour coupler need not necessarily be present in the light sensitive silver halide emulsion layer for this purpose but may equally well be present in a light insensitive layer of binder adjacent to the silver halide emulsion layer. The colour photographic recording material according to the invention generally contains at least three silver halide emulsion layers differing in their spectral sensitivity and colour couplers associated with them, the term "associated" being used also to include the relationship between the spectral sensitivity of the silver halide emulsion layer and the colour of the dye produced from the associated colour coupler by chromogenic development. Generally, the colour of the image dye is complementary to the colour of the light recorded in the associated silver halide emulsion layer. The various silver halide emulsion layers of different spectral sensitivities need not necessarily be arranged in any particular sequence, the arrangement depending on the particular requirements and characteristics (e.g. development kinetics) of the individual layers. Thus the red sensitized silver halide emulsion layer, for example, may be arranged directly adjacent to the transparent support layer or as the furthest removed silver halide emulsion layer, i.e. directly adjacent to the light reflective opaque layer. The same also applies to the other emulsion layers.

Layers having different spectral sensitivities are generally separated by light insensitive intermediate layers in order to prevent unwanted diffusion of developer oxidation products into colour coupler-containing layers which are not (spectrally) associated with them. These intermediate layers may be layers of pure binder or they may be layers of binder containing further additives, such as compounds capable of reacting with diffusible developer oxidation products, or filter dyes, hardeners, embedded developers or UV absorbents.

The colour couplers are generally of a type capable of being incorporated in photographic casting solutions with the aid of oil formers. They are generally soluble in organic solvents, in particular in oil formers (so called hydrophobic couplers) although hydrophilic couplers may also be used. The couplers are 2-, 4- or 6-equivalent colour couplers (Research Disclosure 19,536 July 1980). They are generally colourless and normally contain a ballast group, preferably in a non-coupling position, so that they become incorporated in their respective layer in a diffusion fast form. When chromogenic development takes place, these couplers give rise to the various image dyes. Other couplers may be used in addition, e.g. white couplers or DIR couplers.

The colour photographic recording material according to the invention contains as another essential constituent a light-reflective, opaque layer (layer element 3) arranged above the light-sensitive element. This light-reflective, opaque layer is permeable to aqueous alkaline solutions. Its main function is to provide an aesthetically pleasing background to the colour image produced in the light-sensitive element. This background may be obtained in known manner by means of a layer binder containing a light pigment, in particular a white pigment, e.g. $TiO_2$ or $BaSO_4$. Suitable for this purpose, for example, is a gelatine-containing layer of binder containing from 5 to 50 g $TiO_2$ per $m^2$.

The photographic recording material may also contain additional auxiliary layers, such as UV-absorbent layers or additional protective layers. For example, a hardened protective layer may be situated on the side of the light reflective opaque layer of binder remote from the transparent support layer for the purpose of protecting the opaque layer against mechanical damage. Such a layer may also contain roughening agents, e.g. $SiO_2$ dispersions or certain organic polymers, e.g. particles of polymethacrylate or of hardened gelatine, the object of which is to facilitate writing or marking on the back of the photographic material or of the picture produced from it.

The photographic recording material may also contain additional photographically- or chemically-active substances in one or more of its layers, e.g. in a layer of binder situated on that side of the light reflective layer which is remote from the transparent support layer. Examples of such substances include hardeners, antioxidents, anti-static agents, developers, stabilizers and white couplers. If developers are incorporated, photographic processing can be considerably simplified since development then only involves treatment with a simple alkaline solution.

The recording material according to the invention affords numerous advantages:

(1) The transparent support layer permanently protects the colour image against mechanical damage such as scratching, against bleaching, e.g. by the action of damaging radiation in the ultra-violet and visible region of the spectrum, against blemishing, e.g. by ink, and against other damaging environmental influences such as solvent vapour, exhaust gases, and chemical vapours and mists. Subsequent application of a protective layer is therefore unnecessary. A suitable UV absorbent may be incorporated with the transparent support if desired or necessary or a suitable substrated support may be used.

(2) Problems such as have been occurring for some time now in the form of detachment of layers due to ageing in polyethylene coated paper are eliminated.

(3) Penetration of processing liquids into the edges of the layers of conventional colour papers from the sides, i.e. so called edge-penetration, does not occur.

(4) In individual cases, the transparent support layer employed may be less expensive than a conventional paper support based on a polyethylene coated paper. All the problems of bonding and casting of the layers arising from the particular properties of polyethylene are also eliminated.

(5) The arrangement of layers in the order of cyan, magenta and yellow which is at present regarded as optimal for photographic reasons can be altered to provide for improved developability (sensitivity) of yellow.

(6) The arrangement of layers according to the invention also allows the incorporation of additives which inspite of their photographic effectiveness cannot be used in conventional recording materials on account of their insufficient transparency or their self-colour or other disturbing factors. Such additives include anti-oxidants, developers, anti-static agents, stabilizers for high temperature processing, substances which seal the recording material by rendering it hydrophobic by reactions either during or after processing, or micro-capsules containing photographically-active substances. Such additives may be incorporated in layers which are not photographically active in the recording material according to the invention, e.g. in particular in a layer of binder arranged on that side of the light reflective, opaque layer which is remote from the transparent layer support.

(7) Bonding of the processed recording material to a main layer support becomes unnecessary.

Processing is carried out by a conventional method and comprises the usual steps of colour development, bleaching and fixing (or bleach fixing).

The recording material according to the invention may be used to produce positive colour images to be viewed by reflected light, using colour negatives or colour diapositives. When colour diapositives are used, the necessary reversal may be achieved by subjecting the recording material to a process of reversal colour development in known manner after image-wise exposure.

EXAMPLE 1

A colour photographic recording material I according to the present invention was prepared by applying the following layers one above the other in succession to a support layer of polyethylene terephthalate approximately 110 μm in thickness which was covered with an adhesive layer (the quantities given are based on 1 $m^2$):

First layer: red-sensitive, silver halide, emulsion layer with incorporated cyan coupler A. Application: 0.4 g of $AgNO_3$; $AgNO_3$/coupler = 1:1

Second layer: intermediate layer. Application: 1.4 g of gelatine

Third layer: green-sensitive, silver halide, emulsion layer with incorporated magenta coupler B. Application: 0.5 g of $AgNO_3$; $AgNO_3$/coupler = 1:0.8

Fourth layer: intermediate layer. Application: 1.3 g of gelatine

Fifth layer: blue-sensitive, silver halide, emulsion layer with incorporated yellow coupler C. Application: 0.55 g of $AgNO_3$; $AgNO_3$/coupler = 1:1.5

Sixth layer: intermediate layer. Application: 1 g of gelatine

Seventh layer: light-reflective layer. Application: 18 g of $TiO_2$ and 2 g of gelatine Eighth layer: protective layer with hardener. Application: 0.3 g of gelatine, 0.3 g of hardener D.

A recording material II according to the state of the art carrying the following layers on a paper support for photographic purposes coated with polyethylene on both sides was used for comparison:

First layer: blue-sensitive, silver halide, emulsion layer with incorporated yellow coupler C. Application: 0.55 g of $AgNO_3$; $AgNO_3$/coupler = 1:1.5

Second layer: intermediate layer. Application: 1.3 g of gelatine

Third layer: green-sensitive, silver halide, emulsion layer with incorporated magenta coupler B. Application: 0.5 g of $AgNO_3$; $AgNO_3$/coupler = 1:0.8

Fourth layer: intermediate layer. Application: 1.4 g of gelatine

Fifth layer: red-sensitive, silver halide, emulsion layer with incorporated cyan coupler A. Application: 0.4 g of $AgNO_3$; $AgNO_3$/coupler = 1:1

Sixth layer: protective layer with hardener. Application: 0.3 g of gelatine; 0.3 g of hardener D.

Recording materials I and II were exposed image-wise, processed for colour development in the usual manner and dried, and the following substances were then applied drop-wise to the image sides;

1. Coffee
2. Oil
3. Beer
4. Liqueur
5. Ketchup
6. Lemonade
7. A commercial water insoluble adhesive (Uhu ®).

Five minutes after application, both samples were wiped or washed with water or a suitable solvent. No visible patches or residue are left on recording material I whereas recording material II used as comparison shows clear signs of residues which render the image unusable.

In a second comparison in which the materials were tested by scratching, only the comparison material (recording material II) showed traces of scratching extending over several colour layers, again rendering the image unusable.

EXAMPLE 2

A colour photographic recording material III according to the invention was prepared by application of the following layers to a support layer of polyethylene terephthalate ca. 110 μm in thickness which was covered with a layer of adhesive:

First layer: blue-sensitive, silver halide, emulsion layer with incorporated yellow coupler C. Application: 0.55 g of $AgNO_3$; $AgNO_3$/coupler = 1:1.5

Second layer: intermediate layer. Application: 1.3 g of gelatine

Third layer: green sensitive, silver halide, emulsion layer with incorporated magenta coupler B. Application: 0.5 g of $AgNO_3$; $AgNO_3$/coupler = 1:0.8

Fourth layer: intermediate layer. Application: 1.4 g of gelatine

Fifth layer: red-sensitive, silver halide, emulsion layer with incorporated cyan coupler A. Application: 0.4 g of $AgNO_3$; $AgNO_3$/coupler = 1:1

Sixth layer: intermediate layer. Application: 1 g of gelatine

Seventh layer: light-reflective layer. Application: 18 g of $TiO_2$ and 2 g of gelatine Eighth layer: protective layer with hardener. Application: 0.3 g of gelatine; 0.3 g of hardener D.

EXAMPLE 3

A recording material IV according to the invention was prepared as described in Example 2 except that a gelatine layer containing 0.4 g of 2-(2-hydroxy-3-sec-butyl-5-tertiary butyl)-benzotriazole (UV absorbent) was arranged as lower-most layer between the support and the first layer.

A recording material V similar to material II but with the addition of 0.4 g of 2-(2-hydroxy-3-sec-butyl-5-tertiary butyl)-benzotriazole in the sixth layer was used for comparison.

After exposure and the usual colour processing, recording materials IV and V were exposed to $7.2 \times 10^4$ lux hours in a xeno test apparatus.

The percentage loss in density when the original densities were 0.5, 1.0 and 1.5 may be seen from the following table for the partial colours yellow (y), magenta (mag) and cyan (cy). The values obtained when using comparison material V are given in brackets ().

TABLE

| | Percentage loss in density at density | | |
|---|---|---|---|
| | 0.5 | 1.0 | 1.5 |
| y | 11 (14) | 11 (15) | 12 (14) |
| mag | 13 (18) | 12 (19) | 10 (12) |
| cy | 11 (15) | 10 (14) | 7 (10) |

EXAMPLE 4

A recording material VI according to the invention was prepared by the method described in Example 2 except that an additional gelatine layer containing 0.8 g of 2,5-diisooctylhydroquinone was arranged between the seventh and eighth layer. Recording material VI and recording material II from Example 1 (for comparison) were processed without exposure by the standard Kodak Ektaprint 2 Process (for Ektaprint 74 RC paper, Kodak Manual 1976). Both materials were then stored in a tropical cupboard for 7 days at 86% relative humidity and 35° C. The results (density values) are shown in the Table below; the measurements were carried out using a Macbeth RD 514 Densitometer.

TABLE

| | Density (fog) | | | | | |
|---|---|---|---|---|---|---|
| | Fresh | | | After storage | | |
| Material | y | mag | cy | y | mag | cy |
| VI | 0.10 | 0.10 | 0.09 | 0.12 | 0.11 | 0.11 |
| II | 0.13 | 0.12 | 0.11 | 0.16 | 0.13 | 0.14 |

ANNEXE OF FORMULAE TO THE EXAMPLES

A

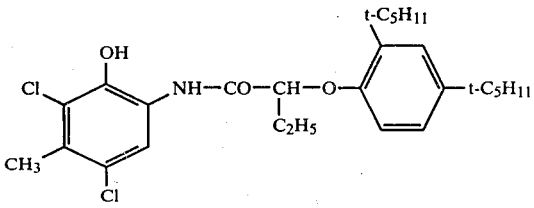

B

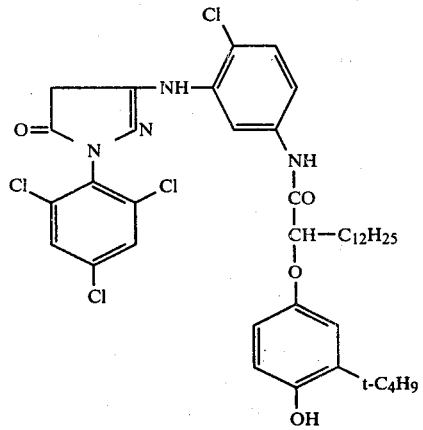

C

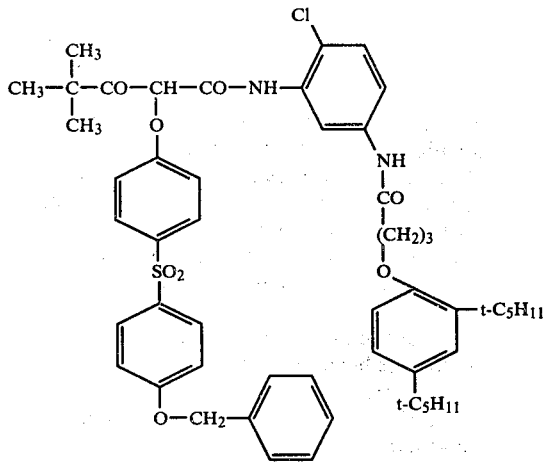

D

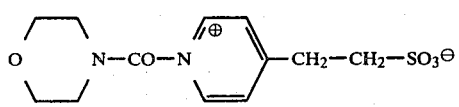

We Claim:

1. Photographic recording material having a single support layer for the preparation of colour images to be viewed by reflected light, in which said photographic material consists essentially of a layer combination in the following order, a transparent support layer which has a smooth and glossy surface on both sides, a light-sensitive element of one or more light sensitive, silver halide emulsion layers each with spectrally associated, non-diffusible colour couplers, and a light-reflective opaque layer of binder, wherein the transparent support layer consists of a transparent cellulose triacetate foil having a layer thickness of at least 90 μm or of a transparent polyethylene terephthalate foil having a layer thickness of at least 70 μm and wherein said support layers have a surface gloss on both sides of from 60 to 100% measured at 45° in a Goniometer and using a black glass plate as standard, and a layer of binder containing a photographically- or chemically-active substance arranged on that side of the light reflective layer which is remote from the transparent support layer and wherein said substance of said binder layer is permeable into and through said opaque layer.

2. Photographic recording material according to claim 1, characterised in that the photographically- or chemically-active substance is a hardener, an anti-oxidant, an anti-static agent, a developer, a stabilizer or a white coupler.

* * * * *